United States Patent [19]

Ryder et al.

[11] Patent Number: 4,543,882

[45] Date of Patent: Oct. 1, 1985

[54] CONTACT LENS MARKING FIXTURE

[76] Inventors: Francis E. Ryder, 5 Pine Lake Dr.; Richard Rabenau, 24 Pine Lake Dr., both of Arab, Ala. 35016

[21] Appl. No.: 630,937

[22] Filed: Jul. 16, 1984

[51] Int. Cl.[4] ..... B41F 17/00

[52] U.S. Cl. ..... 101/35; 101/114; 101/125; 101/126; 206/5.1

[58] Field of Search ..... 101/35, 114, 125, 126; 206/5.1

[56] References Cited

U.S. PATENT DOCUMENTS

| | | | |
|---|---|---|---|
| 1,258,289 | 3/1918 | Winston | 101/114 |
| 1,604,152 | 10/1926 | Drescher | 101/114 X |
| 2,097,832 | 11/1937 | Brenner | 101/35 |
| 2,617,200 | 11/1952 | Klein | 101/35 X |
| 2,819,668 | 1/1958 | McAneny | 101/125 |
| 2,911,906 | 11/1959 | Kiang | 101/125 |
| 3,822,780 | 7/1974 | Ulmer et al. | 206/5.1 |
| 4,228,136 | 10/1980 | Thomas | 206/5.1 X |

FOREIGN PATENT DOCUMENTS

| | | | |
|---|---|---|---|
| 682874 | 10/1939 | Fed. Rep. of Germany | 101/114 |
| 2941793 | 4/1981 | Fed. Rep. of Germany | 101/114 |
| 3219890 | 12/1983 | Fed. Rep. of Germany | 101/35 |

*Primary Examiner*—Clifford D. Crowder

[57] ABSTRACT

A molded plastic resin contact lens marking fixture is provided having a cup-like base with an upstanding internal pedestal having an upper surface which is a segment of a sphere for receiving a contact lens. The axis of the segment is tipped from the vertical so that a peripheral portion of the lens is in uppermost position. A lid is received over the base and includes a masking area which is resiliently urged toward the uppermost portion of the pedestal. Perforations are provided in the masking area, and a dye well is provided above the masking area so that dye in the well will be transmitted through the perforations to mark a contact lens near the periphery thereof.

16 Claims, 4 Drawing Figures

CONTACT LENS MARKING FIXTURE

BACKGROUND OF THE INVENTION

Soft contact lenses for vision correction are generally constructed of clear hydrophilic plastic resin material. Although typically the left eye correction and right eye correction for a given patient are different, it is difficult or impossible to tell from a simple visual inspection which is for the right eye and which is for the left eye. The situation may further be complicated in connection with soft contact lenses in that such a lens can become inverted, and this is not always readily discernable from a simple visual inspection.

OBJECTS AND BRIEF SUMMARY OF THE PRESENT INVENTION

It is an object of the present invention to provide a fixture for ready marking of contact lenses as to which is a right lens and which is a left lens.

More particularly, it is an object of the present invention to provide such a fixture comprising a cup-like container having an upstanding pedestal or anvil for supporting a contact lens, with a mask being provided by a lid for the container for marking of the lens as to left or right.

In achieving the foregoing and other objects a disposable plastic cup-like container is provided having a pedestal or anvil integrally formed therein with a generally spherical lens supporting surface which is tipped to one side so that a lens is supported with a peripheral portion thereof in a raised location. A cover for the container is provided with an integral resilient mask which presses against the contact lens to be marked. A small well or dye cavity is formed integrally with the cup lid for receipt of a dye-impregnated paper disc and distilled water for producing a liquid dye operable with the aforesaid mask to mark the contact lens with an "R" or an "L" to indicate right or left lens. The dye marking is on the convex surface of the lens and is read from the convex surface, whereby it is a simple matter to ascertain whether the lens is in its proper right-side-out condition or whether the lens has been inadvertently inverted.

THE DRAWINGS

The present invention will best be understood from the following specification when taken in connection with the accompanying drawings wherein.

DETAILED DESCRIPTION OF THE ILLUSTRATED EMBODIMENT

Turning now in greater particularity to the figures of the drawings there will be seen a contact lens marking fixture 10 constructed in accordance with the principles of the present invention. The fixture includes a cup-like base 12 having an upwardly and outwardly tapered sidewall 14 molded of a suitable plastic resin material.

Figure 2:
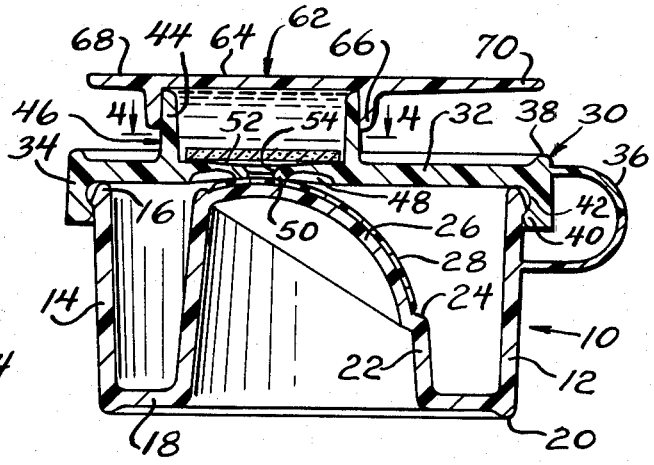
FIG. 2 is an axial sectional view through the fixture of FIG. 1.
Figure 3:
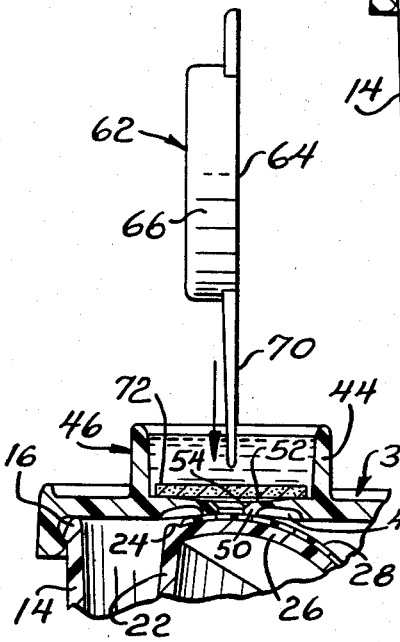
FIG. 3 is a fragmentary view corresponding to a portion of FIG. 2 showing the parts at a different portion of the sequence of marking a contact lens.

The sidewall is provided at its upper edge with a thickened rim 16. An integral, flat bottom 18 is slightly inset upwardly from the bottom edge of the sidewall 14, leaving a short depending flange 20 on which the fixture rests. The bottom wall 18 is provided with an integral upstanding pedestal 22 tapering upwardly and inwardly from the bottom wall 18. The pedestal 22 is substantially oval or eliptical in cross-section and has a diagonally disposed upper rim 24 surmounted by a similarly diagonally disposed spherical segment anvil 26 integral with the pedestal 22. The axis of the spherical segment is diagonal or inclined. The anvil is configured and dimensioned to receive a soft contact lens 28 in tilted or tipped position as shown in FIGS. 2 and 3. The uppermost portion of the anvil 26 lies in the plane of the top edge of the sidewall 14. The contact lens and its relation to the fixture will be discussed in greater detail hereinafter.

The fixture is provided with a lid 30 having a flat top 32 of significant thickness, and having an encircling sidewall 34. A strap 36 integrally joins the lid 30 to the cup-like base 12, the strap being integrally formed with the sidewall 14 of the base and the sidewall 34 of the lid 30.

The sidewall 34 extends slightly above the top wall 32, providing an upstanding rim 38. The sidewall 34 also depends below the top wall 32 and is provided at the bottom edge with an inwardly directed peripheral flange 40 defining an annular recess 42 receiving the enlarged upper edge 16 of the sidewall 14 thereby aggressively to retain the lid on the base.

The lid 30 is provided with an upstanding annular wall 44 which is eccentrically disposed relative to the remainder of the lid. The wall 44 coacts with the top wall 32 to define a well 46.

Figure 1:
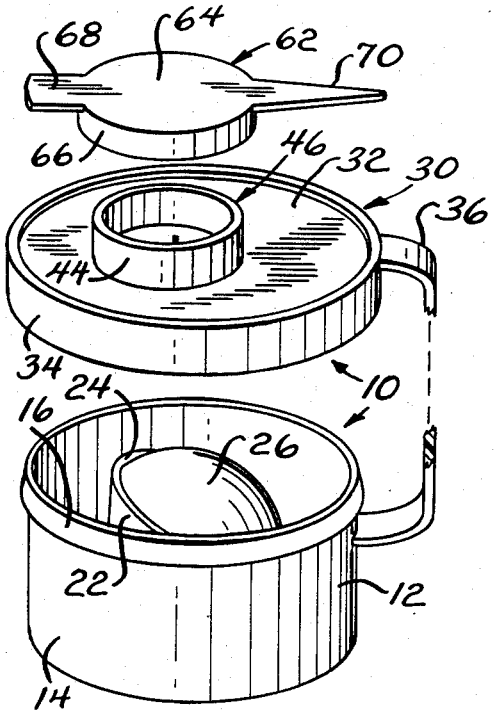
FIG. 1 is an exploded perspective view of a contact lens marking fixture constructed in accordance with the present invention.
Figure 4:
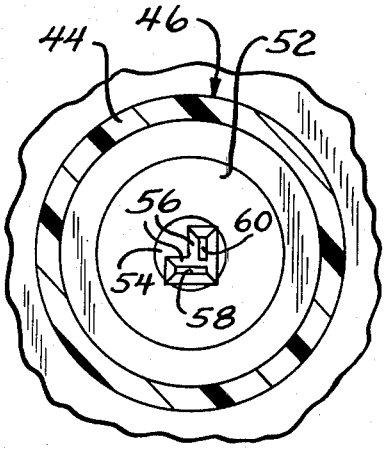
FIG. 4 is a top view partially in section as taken substantially along the line 4—4 in FIG. 2.

The base of the well 46 defines the masking means which will engage the lens 28 and in effect control and restrict the area on the lense 28 to which the dye is applied. The masking means designated generally 52 in FIGS. 2–4 is resilient to insure that it will press against the lens 28 with sufficient force to effect the desired masking function. In this regard, beneath the well 46 and coaxial with the wall 44 there is provided an annular recess 48 in the underside of the top wall 32 of the lid in the area of the masking means 52. The recess 48 defines a resilient annular area of reduced wall thickness which enscribes a central area 50 in which the indicia defining openings are formed. To enhance the resilient nature of the masking means 52, the thickness of the top wall 32 is further reduced on the side thereof opposite the annular recess or groove 48. As such the central area 50 of the masking means 52 is connected to the top wall 32 by a resilient area of reduced thickness which can flex to insure that the indicia carrying central area 50 is pressed or urged against the surface of the contact lens near the periphery thereof with the desired degree of engagement. That is, with sufficient force to control the application of dye, but not with such force as to damage the lens.

Partly above the recess 48 and proximate the central area 50, the top of the top wall 32 is further relieved at 54. The relieved or depressed area 54 is further tapered down at 56 to openings 58 and 60 essentially defining a letter L, designating the left lens. The structure used in marking the right lens is identical, except that the letter R is defined, rather than the letter L.

All of the parts of the contact lens marking fixture as heretofore shown and described, are integrally molded of a relatively soft, semi-rigid plastic resin material, any number of well known materials being suitable, such as polypropylene. The integral connection of the lid to the base through the strap 36 is important, in that this insures proper alignment of the lid with the base, particularly proper alignment of the masking means 52 and its openings 58 and 60 with the anvil 26 on which the soft contact lens 28 is supported. It is important that the marking be adjacent the periphery of the lens so that it is disposed outwardly of the pupil where it cannot interfere with vision, and where it is substantially invisible against the iris.

A cap 62 is provided for the well 46 and includes a flat top 64 and a depending annular wall or flange 66 which frictionlly embraces the wall 44. As will be seen particularly in FIG. 2 the wall or flange 66 is about half as high as the wall 44. A substantially rectangular finger gripping tab 68 is coplanar with the top wall 64 and extends radially outwardly from the flange 66. Diagonal opposite to the tab 68 there is an elongated, pointed stylus 70 coplanar with the top wall 64 and extending radially from the flange 66. The stylus is defined by two elongated converging side edges. The length of the stylus and the radial dimension of the tab 68 are such that they do not extend beyond the periphery of the lid 30 as may be seen in FIG. 2.

A paper dye disc 72 is provided for making a dye impression on the contact lens 28. The paper disc 72 is of a porous nature and is pre-treated with a dye material of a water soluble nature and commercially available. The disc is then dried or dehydrated, leaving the dye in a powdered form in the disc. Any number of known FDA approved dyes are commercially available and are well suited for this application. The contact lens 28 is pre-soaked in a 5% sodium nitrate solution for approximately 5 minutes. It then is placed upon the anvil of the pedestal as illustrated in FIGS. 2 and 3. The lid 30 then is placed on the base 12 so that the masking means 52 and the central area 50 adjacent the openings 58 and 60 is pressed into engagement with the lens. This engagement tends to squeeze the pre-soaking solution out of the lens and controls the dye application to promote good marking. After the lid 30 is closed distilled water is added to the well 46, also known as a dye cavity. The amount of dye impregnated in the porous paper disc 72 is related to the volume of the well or dye cavity 46 so that when the well is filled with distilled water the desired concentration of dye will be produced.

The cap 62 then is gripped manually and the stylus 70 is aimed down into the well 46 as indicated in FIG. 3. The stylus is used to express the dye from the porous paper disc 72, to stir and mix the dye, and to remove all air bubbles from the area of the indicia apertures or holes 58 and 60 so as to insure full and complete dying or tinting of the lens in the desired area. The fixture and the lens, with the dye in place, are then allowed to sit for approximately ten minutes to insure penetration of the lens material by the dye. The fixture then is tipped up to drain the dye from the well. The dye disc is removed and discarded at this time.

Subsequent to such draining a fixing solution, preferably 5% sulfuric acid, is added to the well. This is allowed to set for approximately one minute which will serve the purpose of fixing the dye so that it will not run on subsequent soaking of the lens. The fixing solution is then poured off.

A solution of 5% sodium bicarbonate is added to the well to neutralize any residual acid solution, and this is allowed to set for 10 minutes.

Sodium bicarbonate solution is then poured off, and the lens is removed from the fixture and is cleaned and disinfected in a standard manner, preferably by placing the lens in a saline solution and subjecting the lens and the saline solution to heat approximately 90 degrees centigrade for a period of time. This is a known procedure.

The contact lens marking fixture as herein shown and described is inexpensive to produce, and preferably is used only once and then discarded. This avoids possible contamination with left over materials which should not be applied to the contact lens out of the listed sequence. It also prevents possible migration of dye and marking on areas of the lens where there should be no marking. The tipping of the lens by the tilted anvil on the pedestal, and the relative positioning of the indicia openings 58, 60 insure marking of the contact lens only near the periphery thereof where the marking is invisible against the iris when the lens is worn.

Besides readily identifying which is the right lens and which is the left lens, and also indicating whether the lens is right-side-out or inverted, the marking is valuable in locating the lens within a cleaning and disinfecting saline solution. Since the lens is clear it can otherwise be difficult to find within such a saline solution.

The specific example of the invention as herein shown and described is for illustrative purposes only. Various changes in structure will no doubt occur to those skilled in the art, and will be understood as forming a part of the present invention insofar as they fall within the spirit and scope of the appended claims.

The invention is claimed as follows:

1. A contact lens marking fixture comprising a cup-like base having a bottom and an upstanding sidewall defining an open upper end, a pedestal upstanding from said bottom and spaced inwardly from said sidewall, said pedestal having an upper surface adapted to receive a contact lens for marking, and a lid received over said open upper end and supported by said sidewall, said lid having a masking area adapted to engage a contact lens on said pedestal upper surface and having perforation means therein for admitting dye to the surface of a contact lens, said lid having a dye well disposed on an exterior surface thereof and above said masking area, said dye well communicating with said perforation means for receiving dye and applying said dye to said contact lens through said perforation means.

2. A contact lens marking fixture as set forth in claim 1 wherein the upper surface of said pedestal comprises a segment of a sphere.

3. A contact lens marking fixture as set forth in claim 1 and further including an interconnection between said lid and said base to insure proper relative positioning thereof.

4. A contact lens marking fixture as set forth in claim 3 wherein said interconnection is integral with said lid and with said base.

5. A contact lens marking fixture as set forth in claim 1, wherein said masking area is connected to said lid by a resilient wall section which urges said masking area toward said pedestal to insure the desired degree of contact between said masking area and said lens.

6. A contact lens marking fixture as set forth in claim 1 and further including a cap for said dye well having a radially extending stylus therein, said cap being manually engageable to direct said stylus into said well for stiring the dye and eliminating bubbles.

7. A contact lens marking fixture as set forth in claim 6 and further including a dry porous dye disc in said well, and liquid in said well to produce liquid dye from said disc, said stylus further being engageable with said disc to aid in producing liquid dye.

8. A contact lens marking fixture as set forth in claim 1 and further including a dry porous dye disc in said well.

9. A contact lens marking fixture as set forth in claim 1 wherein the upper surface of said pedestal and said masking area are substantially in contact with one another to squeeze liquid from a pre-treated contact lens.

10. A contact lens marking fixture as set forth in claim 9 wherein said base sidewall has an enlarged rim, and wherein said lid has a depending flange with an internal recess engageable with said enlarged rim to insure fitting of said lid down tightly on said sidewall with said pedestal upper surface and said masking area substantially in engagement.

11. A contact lens marking fixture comprising a cup-like base having a bottom and an upstanding sidewall defining an open upper end, a pedestal upstanding from said bottom and spaced inwardly from said sidewall, said pedestal having an upper surface adapted to receive a contact lens for marking, and a lid received over said open upper end and supported by said sidewall, said lid having a masking area adapted to engage a contact lens on said pedestal upper surface and having perforation means therein for admitting dye to the surface of a contact lens, said lid having a dye well disposed above said masking area for receiving dye to be applied to said contact lens, said pedestal upper surface comprising a segment of a sphere, the centrally located axis of said segment being tipped from vertical and the uppermost portion thereof being eccentric relative to said base, said dye well having said masking area similarly being eccentric and aligned with the uppermost portion of said pedestal segment of a sphere.

12. A contact lens marking fixture comprising: a cup-like base having a bottom and an upstanding sidewall: a pedestal upstanding from said bottom and spaced inwardly from said sidewall, said pedestal having an upper surface adapted to receive a contact lens for marking; and masking means carried by said base and including a masking area said masking means being positionable over said pedestal with the masking area adapted to engage a contact lens on said pedestal upper surface, and said masking area having perforation means therein for admitting dye to the surface of a contact lens, and a dye well disposed above said masking area on the side of said masking means opposite that engageable with said lens, said dye well for receiving a quantity of dye and being in communication with said perforation means to apply dye to said contact lens.

13. A contact lens marking fixture according to claim 12 wherein said base includes a bottom wall and an upstanding peripheral wall surrounding said pedestal and defining an open upper end, and said marking means comprising a lid member received over said open upper end in engagement with said peripheral wall.

14. A contact lens marking fixture according to claim 12 further including resilient means joining said masking means to said base and urging said masking means toward said pedestal.

15. A contact lens marking fixture according to claim 14 wherein said resilient means is a wall section of reduced thickness.

16. A contact lens marking fixture comprising: a base; a pedestal upstanding from said base; said pedestal having an upper surface adapted to receive a contact lens for marking; and masking means carried by said base and including a masking area said masking means being positionable over said pedestal with the masking area adapted to engage a contact lens on said pedestal upper surface, and said masking area having perforation means therein for admitting dye to the surface of a contact lens, said pedestal upper surface comprising a segment of a sphere, the centrally located axis of said segment being tipped from vertical and the uppermost portion thereof being eccentric relative to said base, said dye well having said masking area similarly being eccentric and aligned with the uppermost portion of said pedestal segment of a sphere.

* * * * *